US007640758B2

(12) United States Patent
Esslinger

(10) Patent No.: US 7,640,758 B2
(45) **Date of Patent: *Jan. 5, 2010**

(54) REFRIGERANT TRACKING/LEAK DETECTION SYSTEM AND METHOD

(75) Inventor: Steve Esslinger, Oak Grove, MN (US)

(73) Assignee: Zero Zone, Inc., North Prairie, WI (US)

( * ) Notice: Subject to any disclaimer, the term of this patent is extended or adjusted under 35 U.S.C. 154(b) by 610 days.

This patent is subject to a terminal disclaimer.

(21) Appl. No.: 11/355,691

(22) Filed: Feb. 16, 2006

(65) Prior Publication Data

US 2006/0179854 A1 Aug. 17, 2006

Related U.S. Application Data

(60) Provisional application No. 60/653,424, filed on Feb. 16, 2005.

(51) Int. Cl.
*F25B 45/00* (2006.01)

(52) U.S. Cl. ..... 62/149; 62/127; 62/509

(58) Field of Classification Search ..... 62/149, 62/77, 127, 228.1, 292, 509
See application file for complete search history.

(56) References Cited

U.S. PATENT DOCUMENTS 665,885 A 1/1901 De Veau
1,203,583 A 11/1916 Clark
4,624,112 A * 11/1986 Proctor ..... 62/149
4,967,567 A * 11/1990 Proctor et al. ..... 62/127
5,009,076 A 4/1991 Winslow
5,161,385 A 11/1992 Schumacher
5,351,037 A 9/1994 Martell et al.
6,623,630 B1 9/2003 Staffler
6,629,420 B2 10/2003 Renders
6,787,713 B2 9/2004 Kuechenmeister et al.
7,377,118 B2 * 5/2008 Esslinger ..... 62/149
2002/0121100 A1 9/2002 Yabuki et al.

* cited by examiner

*Primary Examiner*—Melvin Jones
(74) *Attorney, Agent, or Firm*—Michael Best & Friedrich LLP

(57) ABSTRACT

A refrigeration system includes a mass of refrigerant, a reservoir containing a first portion of the mass of refrigerant, and a condenser containing a second portion of the mass of refrigerant. A first sensor is positioned to measure a first parameter of the reservoir and output a first signal indicative of the first parameter. A second sensor is positioned to measure a second parameter of the condenser and output a second signal indicative of the second parameter. A processor receives the first signal and the second signal to calculate a weight of missing refrigerant.

19 Claims, 2 Drawing Sheets

REFRIGERANT TRACKING/LEAK DETECTION SYSTEM AND METHOD

RELATED APPLICATIONS

This application claims priority to U.S. Provisional Patent Application No. 60/653,424, filed on Feb. 16, 2005, titled "Refrigerant Tracking/Leak Detection System and Method", the entire content of which is incorporated herein by reference.

BACKGROUND

The present invention relates to refrigeration systems generally used in large cooling applications. More particularly, the present invention relates to a system and method for monitoring the quantity of refrigerant within the refrigeration system.

One method of monitoring refrigerant includes placing a mechanical float within a receiver vessel of a refrigeration system. The mechanical float provides a visual indication of the level of refrigerant within the vessel. In this case, the level of refrigerant is only viewed during servicing operations. Alternatively, the mechanical float can include an electrical output signal fed to a tracking system. The tracking system generally includes a visual display and an alarm actuated when the level of refrigerant indicates a nearly empty receiver vessel. However, this method is difficult to employ in heat exchangers such as condensers.

Another method of monitoring refrigerant includes an infrared leak detector. The infrared leak detector includes a sensor placed on the outer surface of refrigeration system elements (e.g. receiver vessel, piping, valves, heat exchangers). By action of an air pump, the infrared detector can sample air surrounding the refrigeration system and detect refrigerant. The presence of refrigerant in the air can indicate the existence of a leak and thus trigger an alarm.

SUMMARY

In one embodiment, the invention provides a refrigeration system including a mass of refrigerant, a reservoir containing a first portion of the mass of refrigerant, and a condenser containing a second portion of the mass of refrigerant. A first sensor is positioned to measure a first parameter of the reservoir and output a first signal indicative of the first parameter. A second sensor is positioned to measure a second parameter of the condenser and output a second signal indicative of the second parameter. A processor is coupled to the first sensor and the second sensor to receive the first signal and the second signal. The processor is operable in response to the first signal and the second signal to calculate a weight of missing refrigerant.

In another embodiment, the invention provides a method of operating a refrigeration system including a quantity of refrigerant having a known weight. The method includes operating a compressor to compress at least a portion of the quantity of refrigerant and produce a flow of compressed refrigerant. The method also includes directing the flow of compressed refrigerant through a condenser to condense the flow of refrigerant, and to a reservoir to collect the flow of refrigerant. The method also includes weighing the condenser to generate a first signal indicative of the weight of the condenser and the weight of the refrigerant within the condenser, and weighing the reservoir to generate a second signal indicative of the weight of the reservoir and the weight of the refrigerant within the reservoir. The method also includes processing the first signal and the second signal to calculate a total weight of refrigerant, and comparing the calculated total weight of refrigerant to the known weight to determine a weight of lost refrigerant.

In another embodiment, the invention provides a refrigeration system that includes a compressor assembly operable to deliver a flow of compressed refrigerant. A condenser receives the flow of compressed refrigerant and discharging a flow of condensed refrigerant. A first sensor is coupled to the condenser and is operable to output a first signal indicative of the weight of the condenser and the refrigerant entrained therein. A reservoir is in fluid communication with the condenser to receive the flow of condensed refrigerant. A second sensor is coupled to the reservoir and is operable to output a second signal indicative of the weight of the reservoir and the refrigerant entrained therein. A processor is operable to calculate a weight of refrigerant within the refrigeration system at least partially in response to the first signal and the second signal. A passageway interconnects the condenser and the reservoir to provide fluid communication therebetween. The passageway includes a resilient portion movable in response to relative movement between the condenser and the remainder of the passageway.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
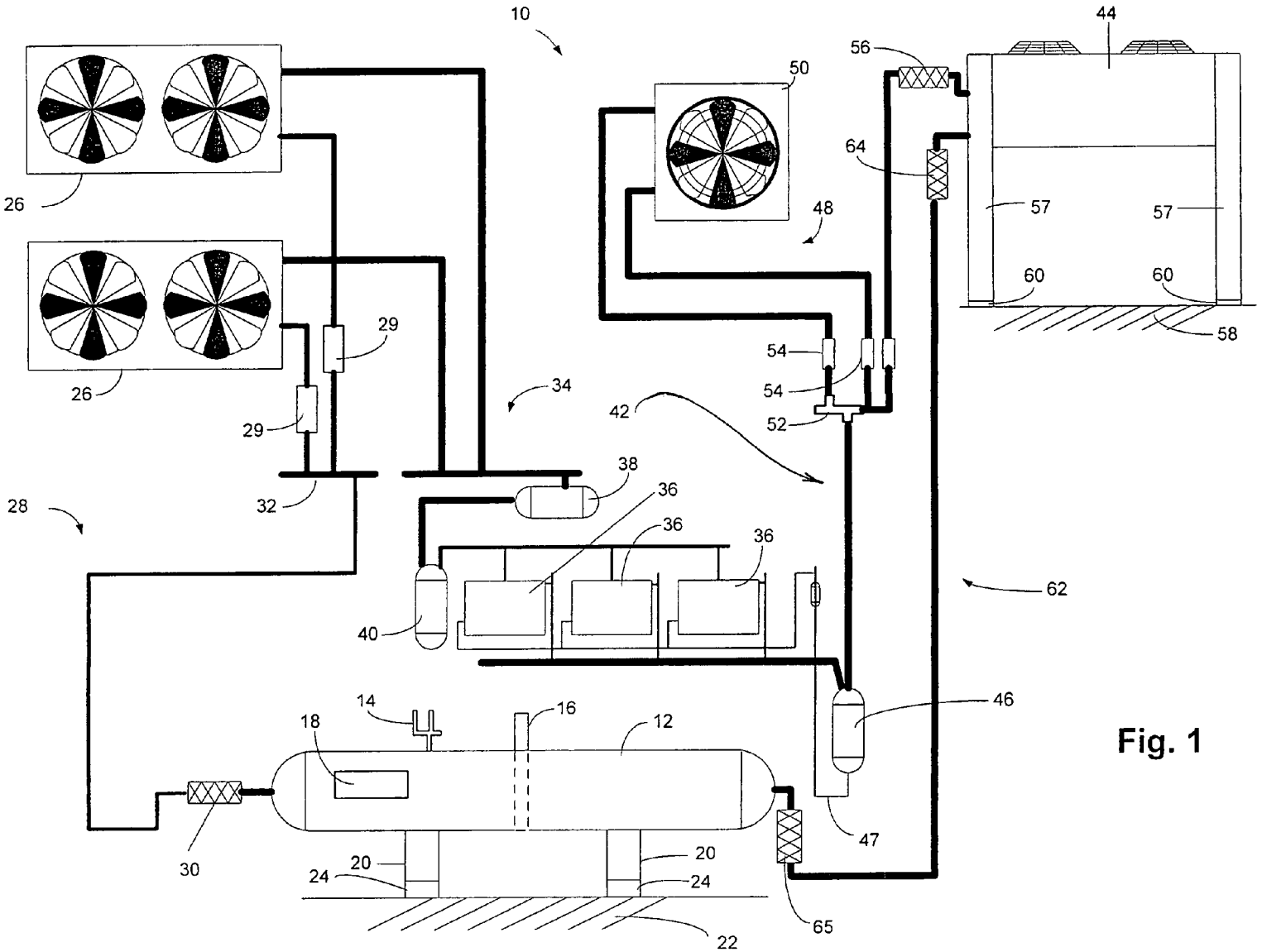
FIG. 1 is a schematic representation of a refrigeration system embodying the invention.

FIG. 1 is a schematic representation of a refrigeration system 10 operable to measure at least a portion of a mass of refrigerant within the refrigeration system 10, and to detect a quantity of refrigerant missing from the refrigeration system 10. It is to be understood that other constructions of the refrigeration system 10 are possible and that the components described herein are for illustrative purposes only. Moreover, the basic operation of refrigeration systems is known by those skilled in the art and thus will not be described in detail.

The refrigeration system 10 includes a reservoir 12 that generally contains a portion of the mass of refrigerant. More specifically, the reservoir 12 is configured to collect the portion of the mass of refrigerant and to deliver another portion of the mass of refrigerant. The portion of the mass of refrigerant collected in the reservoir 12 is generally in a liquid state. In some modes of operation of the refrigeration system 10, the amount of refrigerant within the reservoir 12 is substantially constant, as the reservoir 12 collects a flow of refrigerant and delivers another flow of refrigerant at a substantially equal rate. The reservoir 12 may be generally cylindrical and defines an enclosed space. Other constructions of the refrigeration system 10 can include a reservoir with different shapes or configurations. For example, in another construction, a plurality of tanks are interconnected to define the reservoir 12.

The reservoir 12 shown in FIG. 1 includes a relief valve 14, a liquid level probe 16, a liquid level indicator 18, and at least two supports 20. The relief valve 14 is generally used to release pressure from the reservoir 12 and can be operated automatically or manually. The liquid level probe 16 and the liquid level indicator 18 are used to measure and indicate the amount of refrigerant contained within the enclosed space of the reservoir 12. The liquid level indicator 18 can incorporate a mechanical or an electrical display to indicate a value representative of the amount of refrigerant contained in the reservoir 12.

The supports 20 include two or more legs that extend from the bottom of the reservoir 12 to support the reservoir 12 above a surface 22. A sensor 24 is generally placed between the reservoir 12 and the surface 22. For example, one sensor 24 is positioned between each support 20 and the surface 22, as shown in FIG. 1. Each sensor 24, such as a load sensor, is operable to detect at least one characteristic of the reservoir 12 and to generate a signal indicative of the at least one characteristic of the reservoir 12. In the illustrated construction, each sensor 24 is shown between one support 20 and the surface 22 such that the generated signal is at least partially indicative of the weight of the reservoir 12 and the refrigerant entrained therein. In other constructions, one sensor 24 can be placed between the reservoir 12 and the support 20. Moreover, the sensor 24 can be an integral part of the structure of each support 20. In still other constructions, more than one sensor 24 can be coupled to each support 20 or to different sections of the reservoir 12.

As shown in FIG. 1, the refrigeration system 10 also includes two heat exchangers or evaporators 26 fluidly connected to the reservoir 12 by a first piping portion 28. Each evaporator 26 is associated with one or more spaces to be cooled. As such, other constructions of the refrigeration system 10 can include more or fewer evaporators 26 as required. As shown in FIG. 1, the evaporators 26 are each associated with an expansion valve 29 that facilitates the expansion of the refrigerant. Following expansion, the low-pressure, low-temperature refrigerant flows into the heat exchanger of the corresponding evaporator 26 to provide cooling.

The first piping portion 28 and other piping portions (subsequently described) generally include metal pipes (e.g. aluminum, copper, stainless steel, galvanized steel) capable of containing the mass of refrigerant at pressure. In other constructions, the pipes can be manufactured using other materials capable of supporting the mass of refrigerant. In addition, while the term "pipe" has been used to describe the piping portions, other constructions may use tubes or other flow passages to convey fluids through the system. As such, the terms "pipe" and "piping portions" should be interpreted broadly to include any closed device, passageway, conduit, etc. suitable for conveying fluid.

The first piping portion 28 includes a first flexible pipe portion 30 in relatively close proximity to the reservoir 12, and a distribution section 32 that directs the flow of refrigerant from the reservoir 12 to the evaporators 26. In the construction shown in FIG. 1, the distribution section 32 includes a liquid manifold portion that distributes refrigerant to the two evaporators 26. In other constructions, the distribution portion 32 can define a different structure operable to feed refrigerant to a different number of evaporators 26. Moreover, the distribution portion 32, as well as other components illustrated in FIGS. 1-2, can include additional parts or sections not shown in FIGS. 1-2.

Flexible pipe portions, such as the first flexible pipe portion 30, can be manufactured using any suitable materials or configurations capable of transporting refrigerant, and preferably include resilient properties such as being capable of flexing or moving (e.g., corrugated tubes, woven tube, etc.). In the construction shown in FIG. 1, the first flexible pipe portion 30 is positioned near the reservoir 12 to help isolate the weight of the reservoir 12 and the mass of refrigerant within the reservoir 12 from the first piping portion 28. Specifically, the flexible pipe portion 30 moves in response to relative movement between the remainder of piping portion 28 and the reservoir 12. This reduces the forces applied to the reservoir 12 by the pipe portion 28 and allows for more accurate weight measurements. It is to be understood that other flexible pipe portions subsequently described also include the same characteristics and capabilities as the first flexible pipe portion 30. For example, flexible pipe portions can help isolate an element (e.g. reservoir 12) from pipes connected to the element for weighing purposes.

In the construction shown in FIG. 1, the refrigeration system 10 also includes a second piping portion 34 fluidly connecting the evaporators 26 to a compressor section that includes three compressors 36 operating in a parallel configuration. Of course, other constructions may include more or fewer compressors arranged in parallel, series or a combination as required. The second piping portion 34 includes a filter 38 and a suction accumulator 40. The compressors 36 generally receive refrigerant from the evaporators 26 and compress the refrigerant to increase the pressure of the refrigerant.

A third piping portion 42 fluidly connects the compressors 36 to a heat exchanger such as a condenser 44. In the construction shown in FIG. 1, the third piping portion 42 includes an oil separator 46 that separates oil from the refrigerant flowing from the compressors 36. A piping portion 47 routes the oil retrieved by the oil separator 46 back to the compressors 36 for re-use in the compressors 36. The third piping portion 42 also includes a sub-portion of piping 48 for delivering a portion of refrigerant through a heat reclamation coil 50. The sub-portion of piping 48 allows for the use of some of the heat produced during the compression process to heat other systems unrelated to the refrigeration system 10. The omission of the sub-portion of piping 48 does not affect the function of the invention. As such, some constructions omit the sub-portion of piping 48.

In the construction shown in FIG. 1, a valve 52 is used to direct the flow of refrigerant through the sub-portion of piping 48 or directly to the condenser 44. The sub-portion of piping 48 includes two auxiliary valves 54 to help direct the flow of refrigerant. In some modes of operation, the valve 52 directs the flow of refrigerant through the sub-portion of piping 48. In these modes of operation, the auxiliary valves 54 are generally open to allow the flow of refrigerant. In other modes of operation, the auxiliary valves 54 are closed and the valve 52 directs the flow of refrigerant directly to the condenser 44.

The condenser 44 is generally configured to receive refrigerant from the compressors 36 at a first temperature and in a gaseous state, and to release refrigerant at a second temperature, lower than the first temperature, and in a liquid state. In the construction shown in FIG. 1, the condenser 44 includes at least two supports 57 supporting the condenser 44 on a surface 58. At least one sensor 60 is placed between the condenser 44 and the surface 58. For example, a sensor 60 can be placed between the condenser 44 and the support 57 or between the support 57 and the surface 58. Similar to sensors 24, the sensors 60 are configured to detect at least one characteristic of the condenser 44 and to generate a signal indicative of the at least one characteristic of the condenser 44. In the construction shown in FIG. 1, the signal generated by each sensor 60 is at least partially indicative of the weight of the condenser 44 and the refrigerant entrained within the condenser 44. In other constructions, the sensors 60 can be placed at a location different than adjacent to the supports 57 of the condenser 44. In yet other constructions, the sensors 60 can be part of the structure to the condenser 44, thus the signal generated by the sensors 60 can be indicative of other parameters of the condenser 44 (e.g. temperature, pressure, flow rate, etc.).

The refrigeration system 10 also includes a fourth piping portion 62 to move a flow of refrigerant from the condenser 44 to the reservoir 12. The fourth piping portion 62 includes a second flexible pipe portion 64 in close proximity to the condenser 44, and a third flexible pipe portion 65 in close proximity to the reservoir 12. Additionally, the third piping portion 42 includes a fourth flexible pipe portion 56 in close proximity to the condenser 44, as shown in FIG. 1. The first and third flexible pipe portions 30, 65 cooperate with each other to help isolate the reservoir 12 from the first piping portion 28 and the fourth piping portion 62, respectively. The second and fourth flexible pipe portions 64, 56 cooperate with each other to help isolate the condenser 44 from the third piping portion 42 and the fourth piping portion 62, respectively. Isolating the reservoir 12 and the condenser 44 using the first, second, third, and fourth flexible pipe portions 30, 64, 65, 56 generally helps sensors 24, 60 generate signals that, when processed, more accurately indicate the weight of the reservoir 12, the condenser 44, and the refrigerant entrained therein.

Figure 2:
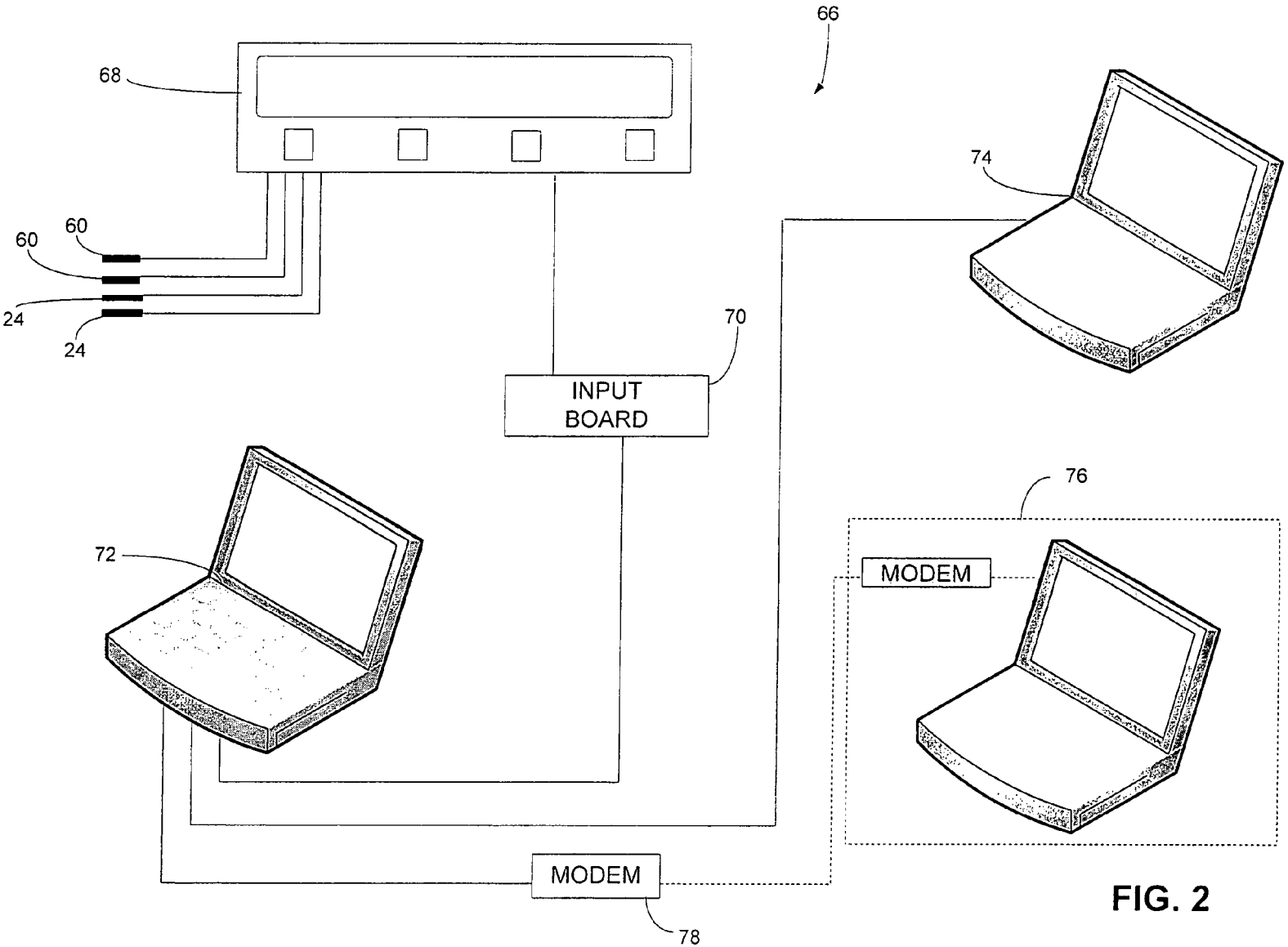
FIG. 2 is a schematic representation of a processing system, suitable for use with the system of FIG. 1 and including a number of sensors.

FIG. 2 is a schematic representation of a processing system 66 including a signal conditioner 68, an input board 70, and a rack controller 72. The sensors 24, 60 are electrically connected to the signal conditioner 68. The signal conditioner 68 receives signals generated by the sensors 24, 60, filters the signals, and generates output signals to be sent to the input board 70. Filtering the signals generally includes applying a low pass filter to the signals generated by the sensors 24, 60 to reduce noise, though other processes are possible. Some constructions can include wirelessly connecting the sensors 24, 60 to the signal conditioner 68. Other suitable means to send the signals generated by sensors 24, 60 to the signal conditioner 68 are also within the scope of the invention.

The input board 70 relays the output signals to the rack controller 72 for processing, recording, transmitting, etc. In the construction shown in FIG. 2, the processing system 66 also includes a first remote computer 74 and a second remote computer 76. For example, the first remote computer 74 can include additional processing tools to process signals from the rack controller 72 in relation to the signals generated by the sensors 24, 60. Additionally, the rack controller 72 connects to the second remote computer 76 via a modem 78 to perform operations similar to those performed by the first remote computer 74. In this case, the second remote computer 76 can be placed at a different physical location than the rest of the elements of the processing system 66. In some constructions, the processing system 66 is part of other automated systems operating the refrigeration system 10. Moreover, the processing system 66 can have other configurations than the one shown in FIG. 2.

In one mode of operation, the processing system 66 receives the signals generated by the sensors 24, 60 for processing and analysis. The signals are processed and analyzed to determine a weight of refrigerant within the reservoir 12 and a weight of refrigerant within the condenser 44. Some of the processes of the processing system 66 include filtering, amplification, recording, and comparing. More particularly, the processing system 66 can combine the calculated weight of refrigerant within the reservoir 12 and the calculated weight of refrigerant within the condenser 44 to compare it to a predetermined value. The predetermined value, generally indicating an actual weight of refrigerant within the reservoir 12 and the condenser 44, can be automatically calculated by the processing system 66 at a start up procedure or manually recorded by a user or technician. The predetermined value can also be a desired weight of refrigerant within the reservoir 12 and the condenser 44. Comparing the predetermined value to the calculated weights of refrigerant allows the processing system to determine a quantity or weight of missing refrigerant. In other modes of operation, the signals generated by the sensors 24, 60 can be processed and manipulated by the processing system 66 to determine other characteristics of the refrigeration system 10.

In general, the value indicative of the combined weight of refrigerant within the reservoir 12 and the condenser 44 is substantially constant under relatively stable operating conditions of the refrigeration system 10. The processing system 66 can continuously or periodically (e.g. once per millisecond, once per minute, every hour, etc.) monitor the weight of refrigerant within the reservoir 12 and the condenser 44. When the calculated weight of refrigerant changes to a value out of a predetermined range, the processing system 66 can initiate an alarm (e.g., audible, visual, written, etc.) indicating a possible undesired condition of the refrigeration system 10. Events that generally disrupt stable operating conditions of the refrigeration system 10, and thus produce undesired refrigerant conditions, include refrigerant leaks and sudden changes in ambient temperature. For example, in some cases the amount of refrigerant within the reservoir 12 combined with the amount of refrigerant within the condenser 44 represents a fixed percentage of the total amount of refrigerant within the refrigeration system 10. In these cases, the calculated amount of missing refrigerant exceeding a predetermined range may be indicative of a refrigerant leak.

Various features and advantages of the invention are set forth in the following claims.

What is claimed is:

1. A refrigeration system comprising:

a mass of refrigerant;

a reservoir containing a first portion of the mass of refrigerant;

a condenser containing a second portion of the mass of refrigerant;

a first sensor positioned to measure a first parameter of the reservoir and output a first signal indicative of the first parameter;

a second sensor positioned to measure a second parameter of the condenser and output a second signal indicative of the second parameter; and a processor coupled to the first sensor and the second sensor to receive the first signal and the second signal, the processor operable in response to the first signal and the second signal to calculate a weight of missing refrigerant, wherein the first parameter is indicative of the weight of the reservoir, and the second parameter is indicative of the weight of the condenser.

2. The refrigeration system of claim 1, further comprising an evaporator, a compressor, and a piping system fluidly connecting the reservoir, the condenser, the evaporator, and the compressor, the piping system including a first resilient portion fluidly connected to the reservoir, and a second resilient portion fluidly connected to the condenser.

3. A refrigeration system comprising:

a mass of refrigerant;

a reservoir containing a first portion of the mass of refrigerant;

a condenser containing a second portion of the mass of refrigerant;

a first sensor positioned to measure a first parameter of the reservoir and output a first signal indicative of the first parameter;

a second sensor positioned to measure a second parameter of the condenser and output a second signal indicative of the second parameter;

a processor coupled to the first sensor and the second sensor to receive the first signal and the second signal, the processor operable in response to the first signal and the second signal to calculate a weight of missing refrigerant; and an evaporator, a compressor, and a piping system fluidly connecting the reservoir, the condenser, the evaporator, and the compressor, the piping system including a first resilient portion fluidly connected to the reservoir, and a second resilient portion fluidly connected to the condenser, wherein the first resilient portion moves in response to a change in the relative position between a portion of the piping system and the reservoir.

4. A refrigeration system comprising:

a mass of refrigerant;

a reservoir containing a first portion of the mass of refrigerant;

a condenser containing a second portion of the mass of refrigerant;

a first sensor positioned to measure a first parameter of the reservoir and output a first signal indicative of the first parameter;

a second sensor positioned to measure a second parameter of the condenser and output a second signal indicative of the second parameter;

a processor coupled to the first sensor and the second sensor to receive the first signal and the second signal, the processor operable in response to the first signal and the second signal to calculate a weight of missing refrigerant; and an evaporator, a compressor, and a piping system fluidly connecting the reservoir, the condenser, the evaporator, and the compressor, the piping system including a first resilient portion fluidly connected to the reservoir, and a second resilient portion fluidly connected to the condenser, wherein the second resilient portion moves in response to a change in the relative position between a portion of the piping system and the condenser.

5. The refrigeration system of claim 1, further comprising a data storage device operable to store a weight value indicative of the weight of at least one of the reservoir and the condenser, the data storage device in communication with the processor.

6. The refrigeration system of claim 5, wherein the processor compares the weight value to the sum of the sensed weight of the reservoir and the sensed weight of the condenser to determine the weight of missing refrigerant.

7. The refrigeration system of claim 6, further comprising an alarm operable in one of an actuated and non-actuated state, the alarm transitioning from the non-actuated to the actuated state in response to the calculated weight of missing refrigerant exceeding a predetermined value.

8. The refrigeration system of claim 1, further comprising a signal conditioner manipulating the first and second signals.

9. The refrigeration system of claim 1, wherein the first sensor and the second sensor are each operable to measure a weight and generate a signal indicative of the measured weight.

10. A method of operating a refrigeration system including a quantity of refrigerant having a known weight, the method comprising:

operating a compressor to compress at least a portion of the quantity of refrigerant and produce a flow of compressed refrigerant;

directing the flow of compressed refrigerant through a condenser to condense the flow of refrigerant and to a reservoir to collect the flow of refrigerant;

weighing the condenser to generate a first signal indicative of the weight of the condenser and the weight of the refrigerant within the condenser;

weighing the reservoir to generate a second signal indicative of the weight of the reservoir and the weight of the refrigerant within the reservoir;

processing the first signal and the second signal to calculate a total weight of refrigerant; and comparing the calculated total weight of refrigerant to the known weight to determine a weight of lost refrigerant.

11. The method of claim 10, further comprising recording a value indicative of the weight of lost refrigerant.

12. The method of claim 10, further comprising actuating an alarm in response to the weight of lost refrigerant exceeding a predetermined value.

13. The method of claim 10, wherein processing the first signal and the second signal includes converting the first signal to a first measured weight, converting the second signal to a second measured weight, and adding the first measured weight to the second measured weight.

14. The method of claim 10, further comprising moving a first resilient portion fluidly connected to the reservoir in response to relative movement between the reservoir and a portion of piping.

15. The method of claim 14, further comprising moving a second resilient portion fluidly connected to the condenser in response to relative movement between the condenser and a portion of piping.

16. A refrigeration system comprising:

a compressor assembly operable to deliver a flow of compressed refrigerant;

a condenser receiving the flow of compressed refrigerant and discharging a flow of condensed refrigerant;

a first sensor coupled to the condenser and operable to output a first signal indicative of the weight of the condenser and the refrigerant entrained therein;

a reservoir in fluid communication with the condenser to receive the flow of condensed refrigerant;

a second sensor coupled to the reservoir and operable to output a second signal indicative of the weight of the reservoir and the refrigerant entrained therein;

a processor operable to calculate a weight of refrigerant within the refrigeration system at least partially in response to the first signal and the second signal; and a passageway interconnecting the condenser and the reservoir to provide fluid communication therebetween, the passageway including a resilient portion movable in response to relative movement between the condenser and the remainder of the passageway.

17. The refrigeration system of claim 16, wherein the processor is operable to compare the calculated weight to a known weight to determine a weight of lost refrigerant.

18. The refrigeration system of claim 17, further comprising an alarm transitionable from a non-alarm condition to an alarm condition in response to the weight of lost refrigerant exceeding a predetermined value.

19. The refrigeration system of claim 16, wherein the resilient portion is disposed adjacent the condenser, the passageway further comprising a second resilient portion disposed adjacent the condenser and movable in response to relative movement between the condenser and the remainder of the passageway.

* * * * *

UNITED STATES PATENT AND TRADEMARK OFFICE

CERTIFICATE OF CORRECTION

PATENT NO. : 7,640,758 B2
APPLICATION NO. : 11/355691
DATED : January 5, 2010
INVENTOR(S) : Steve Esslinger It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 933 days.

Signed and Sealed this

Sixteenth Day of November, 2010

David J. Kappos

David J. Kappos
*Director of the United States Patent and Trademark Office*